United States Patent [19]

Miller et al.

[11] 4,264,841

[45] Apr. 28, 1981

[54] PICKUP TUBE HAVING MESH SUPPORT ELECTRODE ALIGNING MEANS

[75] Inventors: Louis D. Miller, Leola; Fred W. Peterson, Lancaster, both of Pa.

[73] Assignee: RCA Corp., New York, N.Y.

[21] Appl. No.: 52,496

[22] Filed: Jun. 27, 1979

[51] Int. Cl.[3] ..... H01J 31/28

[52] U.S. Cl. ..... 313/383; 313/251; 313/292; 313/451; 313/456; 313/390

[58] Field of Search ..... 313/390, 383, 456, 451, 313/292, 251

[56] References Cited

U.S. PATENT DOCUMENTS 3,073,981 1/1963 Miller et al. .

3,746,917 7/1973 French et al. .

*Primary Examiner*—Robert Segal

*Assistant Examiner*—Darwin R. Hostetter

*Attorney, Agent, or Firm*—Eugene M. Whitacre; Dennis H. Irlbeck; Vincent J. Coughlin, Jr.

[57] ABSTRACT

A pickup tube such as a vidicon has an improved structure for precisely aligning a mesh support electrode relative to a focus electrode. The structure comprises a plurality of focus electrode embossments extending radially outward from the focus electrode and a plurality of mesh support electrode embossments extending radially inward from the mesh support electrode. An insulating ring is molded in situ between the focus electrode embossments and the mesh support electrode embossments. The focus electrode embossments and the mesh support electrode embossments are embedded into the insulating ring.

9 Claims, 3 Drawing Figures

PICKUP TUBE HAVING MESH SUPPORT ELECTRODE ALIGNING MEANS

BACKGROUND OF THE INVENTION

This invention relates to pickup tubes having a field mesh support electrode adjacent to one end of a focus electrode and more particularly to a vidicon type camera tube having an improved means for locating the mesh support electrode relative to the focus electrode so that the focus electrode and the mesh support electrode are mutually parallel, concentric and electrically insulated.

One of the several known types of pickup tubes is known generally as a vidicon and generally comprises an evacuated tubular envelope enclosing an electron gun and a target electrode. The target electrode may include a silicon wafer or another photoconductive target supported by a transparent support member, which normally is an optically clear transparent faceplate sealed to the end of the envelope. Closely spaced from the target electrode, facing the electron gun, is a fine mesh screen or beam decelerating mesh electrode. A hollow tubular focus electrode is disposed between the electron gun and the mesh screen. A cylindrical mesh support electrode retains the mesh in spaced relation to the focus electrode.

The operating characteristics of the camera tube will be adversely affected if the mesh support electrode is not electrically insulated from, concentric with, and parallel to the focus electrode. Support structures for locating the mesh support electrode vis-a-vis the focus electrode are disclosed in the U.S. Pat. No. 3,073,981, issued on Jan. 15, 1963 to L. D. Miller et al., entitled "Photoconductive Pickup Tube Having an Electrically Isolated Mesh Assembly." These structures require the accurate location of a plurality of precision parts; however, such parts are expensive and increase the manufacturing cost of the tube. By way of example, the above-mentioned patent discloses two embodiments; one embodiment requires four precision parts while the other requires seven. It is, therefore, desirable to reduce the number of precision parts without adversely affecting the performance of the tube. The term precision part as used herein means a part having at least one dimension held to a tolerance of plus or minus 0.003 inch (0.0762 mm).

SUMMARY OF THE INVENTION

A pickup tube includes an evacuated hollow envelope, a hollow tubular focus electrode within the envelope and a cylindrical mesh support electrode spaced from the focus electrode. An improved aligning means precisely aligns the mesh support electrode relative to the focus electrode. The improved aligning means comprises a first securing means extending radially outward from the focus electrode and a second securing means extending radially inward from the mesh support electrode. Molded in situ between the first and second securing means is an insulating means.

DETAILED DESCRIPTION OF THE PREFERRED EMBODIMENT

Figure 1:
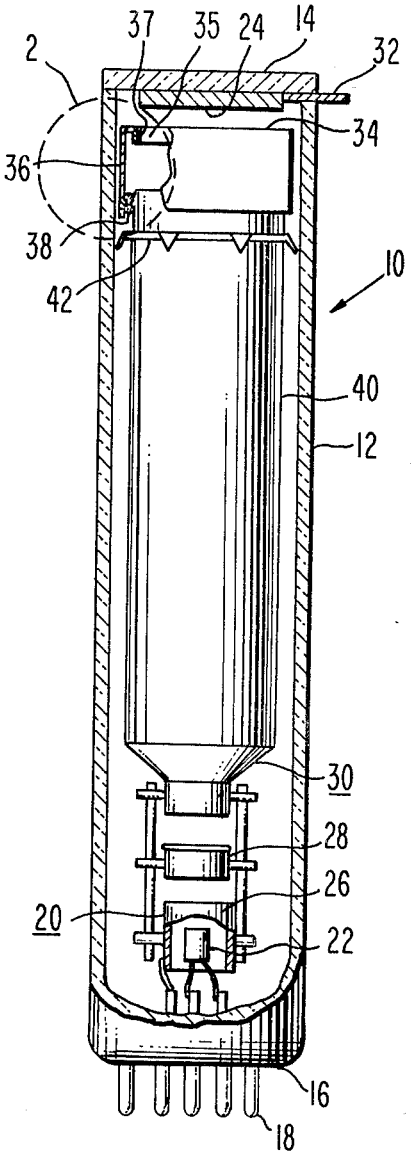
FIG. 1 is a longitudinal sectional view, partially broken away, of an improved camera tube utilizing the novel molded in situ insulating means.

Referring to the drawing, there is shown in FIG. 1 a photoconductive camera tube 10 of a type commercially known as a vidicon. The tube 10 comprises an evacuated, generally cylindrical, glass envelope 12 closed at one end by a transparent faceplate 14 and at the other end by a glass stem 16 through which lead-in pins 18 are vacuum sealed. The envelope 12 is preferably a precision bulb that has an inner diameter held to a tolerance of plus or minus 0.001 inch (0.0254 mm) and that has fairly close tolerance with respect to roundness.

The tube 10 includes a conventional electron gun 20 that is positioned within one end of the envelope 12 substantially on the axis of the tube 10. The electron gun 20 comprises a thermionic cathode 22 for producing an electron beam that is directed toward a target electrode 24 by a control grid 26, an apertured accelerating electrode 28 and a hollow tubular beam focusing electrode, or G3 electrode 30.

The target electrode 24 preferably comprises a silicon wafer. Other photoconductive materials such as a layer of lead monoxide, selenium arsenic telluride, cadmium selenide, or antimony trisulfide, deposited on a film of transparent conductive material such as tin oxide may also be used to form the target electrode 24. An electrical contact may be made to the target 24 by a metallic lead 32, vacuum sealed through the envelope 12.

The tubular beam focusing electrode 30 is terminated at the end proximate the target electrode 24 by a fine mesh screen or beam decelerating electrode 34 that is supported by a mesh ring 35. A cylindrical mesh support electrode 36 is affixed substantially concentrically to the focusing electrode 30. The mesh support ring 35 fits within an inside collar 37 of the mesh support electrode 36. The mesh support electrode 36 is electrically insulated from the beam focusing electrode 30 by a glass ring 38. The mesh screen 34 is preferably of the electroformed type having 500 to 1500 wires per inch (197 to 591 wires per cm).

The beam focusing electrode 30 has an enlarged, elongated cylindrical portion 40, which is supported substantially concentrically within the inner surface of the envelope 12 by a support ring 42.

Figure 2:
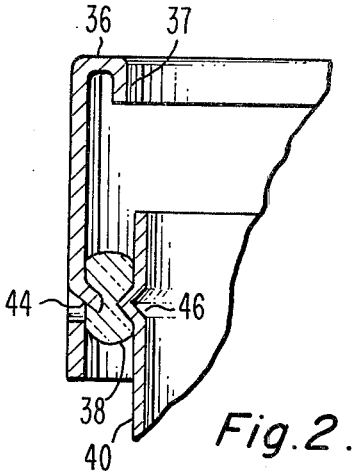
FIG. 2 is an enlarged fragmentary sectional view of the portion of the camera tube within the circle 2 of FIG. 1.

Referring to FIG. 2, the mesh support electrode 36 is shown affixed to the proximal end of the elongated cylindrical portion 40 of the focusing electrode 30 by means of a plurality of embossments 44 which are formed in the cylindrical body of the mesh support electrode 36 as tabs struck from the electrode 36 itself. For clarity, the mesh screen 34 and the mesh ring 35 are not shown attached to the inside collar 37 of the mesh support electrode 36. The embossments 44 extend from the body of the support electrode 36 and are embedded in the insulating glass ring 38 adjacent to the outer circumference of the ring. The embossments 44 are spaced circumferentially about the mesh support electrode 36 and extend radially inward from the electrode 36 for a distance of typically about 0.050 inch (1.27 mm). The embossments 44 are preferably coplanar. The radially inward projecting embossments 44 define a mesh support electrode securing circumference having a diameter of about 0.809 to 0.814 inch (20.55 to 20.68 mm). The focus electrode 30, hereafter called the focus cylinder, also has a plurality of embossments 46 formed in its cylindrical body. The embossments 46 form protrusions on one surface of the focus cylinder 30 and depressions on the opposite surface. The embossments 46 do not break the body of the focus cylinder 30, i.e., they are not struck from the cylinder 30; although it should be clear to one skilled in the art that the embossments 46 may break the body of the focus cylinder 30. The embossments are spaced from the proximal end of the focus cylinder a distance of about 0.070 inch (1.78 mm). The embossments 46 in the focus cylinder 30 extend radially outward from the cylinder for a distance of typically about 0.016 inch (0.41 mm), and are embedded in the insulating glass ring 38 adjacent to the inner circumference of the ring. The radially outward projecting embossments 46 define a focus electrode securing circumference having a diameter of about 0.779 to 0.791 inch (19.79 to 20.09 mm).

An insulating cylindrical glass ring which is subsequently thermally deformed to comprise ring 38 is made of preformed molded glass such as Corning 7761 glass, available from Corning Glass Co., Corning, New York, and is disposed between the focus cylinder 30 and the mesh support electrode 36. The glass ring has an outside diameter of about 0.895 inch (22.73 mm), and inside diameter of about 0.760 inch (19.30 mm), and a height of about 0.125 inch (3.18 mm). The glass ring before thermal deformation or molding in situ has an inside diameter greater than the outside diameter of the focus cylinder 30 but less than the diameter of the focus electrode securing circumference and an outside diameter less than the inside diameter of the mesh support electrode 36 but greater than the diameter of the mesh electrode securing circumference. The glass ring insulates the focus cylinder 30 from the mesh support electrode 36. Since the glass ring 38 is thermally deformed to conform to the spacing between the mesh support electrode 36 and the focus cylinder 30, only the mesh support electrode 36 and the focus cylinder 30 in the present structure are precision parts.

Figure 3:
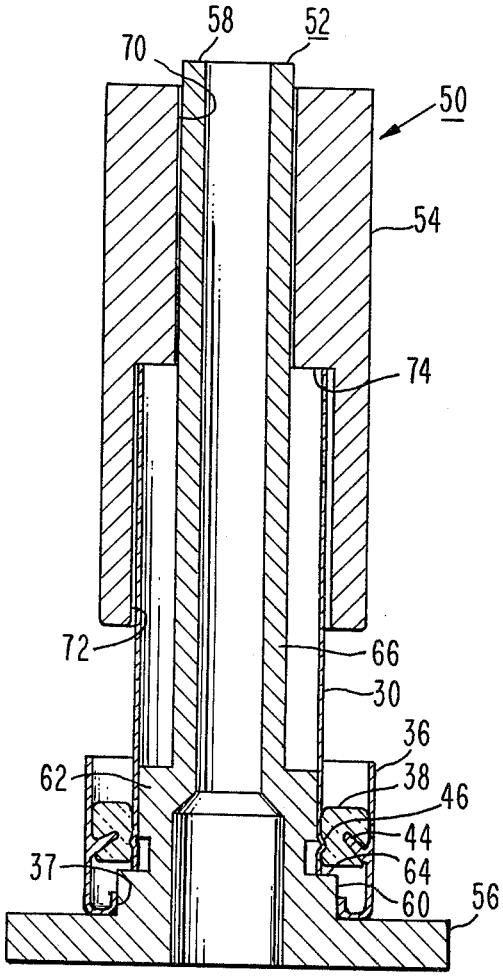
FIG. 3 is an enlarged cross sectional view of a firing fixture used to assemble a mesh support electrode-focus electrode structure of the present invention.

The novel mesh support electrode-focus electrode structure shown in FIG. 2 is assembled using a stainless steel firing fixture 50 shown in FIG. 3. The firing fixture 50 comprises a mandrel 52 and a cylindrical weight 54 of about 400 grams. The mandrel includes a flat base 56 having mutually parallel surfaces and a perpendicular center post 58 formed to include a plurality of concentric centering cylinders of decreasing outside diameter attached to one surface of the base. The center post 58 has a length greater than the length of the focus cylinder 30. The first centering cylinder 60 adjacent to the base has an outside diameter that conforms closely to the diameter of the inside collar 37 of the mesh support electrode 36 and centers the electrode 36 with respect to the center post of the mandrel. The second centering cylinder 62 which has an outside diameter less than the outside diameter of the first centering cylinder is adjacent to the first centering cylinder 60. The second centering cylinder 62 has an outside diameter that conforms closely to the inside diameter of the focus cylinder 30 and fixes the concentricity of the focus cylinder relative to the mesh support electrode. The plane defined by the mutually adjacent surfaces of the first centering cylinder 60 and the second centering cylinder 62 provides a cylindrical stop 64 for the focus cylinder 30 during the assembly operation. The third centering cylinder 66, remote from the base, has an outside diameter which is less than the outside diameter of the first and second centering cylinders. The third centering cylinder provides a slide fit with the cylindrical weight 54. The cylindrical weight has a first inside diameter 70 which extends through a portion of the weight, along the longitudinal axis of the cylinder, and provides a slide fit with the third centering cylinder 66 of the mandrel 52. A second inside diameter 72, concentric with but greater than the first inside diameter 70, extends through the remainder of the cylindrical weight 54 and provides a loose fit with the outside surface of a portion of the focus cylinder 30. The plane or shoulder 74 defined by the abutting inside diameters of the cylindrical weight provides a shoulder which contacts an end of the focus cylinder 30 and evenly distributes the weight to the focus cylinder.

The assembly steps for the mesh support electrode-focus electrode structure are as follows. The mesh support electrode 36 is placed over the first centering cylinder 60 of the mandrel 52 so that the inside collar 37 of the support electrode is adjacent to the base 56 of the mandrel. The glass ring is then placed within the mesh support electrode 36 so that the ring rests on the mesh support electrode embossments 44. Next, the focus cylinder 30 is placed over the second centering cylinder of the mandrel so that the focus cylinder embossments 46 contact the glass ring. The 400 gram cylindrical weight 54 is then placed over the third centering cylinder 66 of the mandrel 52 so that the shoulder 74 provided by the abutting first and second inside diameters 70 and 72, respectively, of the cylindrical weight rest on the end of the focus cylinder 30 which is remote from the focus electrode embossments 46.

The loaded firing fixture 50 is then placed into a furnace having a reducing atmosphere, e.g., dry hydrogen, which will prevent oxidation of the focus cylinder 30 and the mesh support electrode 36. The above-described parts are fired at about 1100° C. or at a temperature above the softening point of the glass ring. As the glass softens, the weight 54 resting on the focus cylinder 30 deforms the softened glass by forcing the focus cylinder 30 downward so that the focus electrode embossments 46 and the mesh support electrode embossments 44 are embedded into the inside diameter and the outside diameter, respectively, of the deformed glass ring 38. Thus the glass ring is molded in situ to form the deformed disposed glass ring 38 which engages the embossments 44 and 46 respectively and fixes the relative alignment between the mesh support electrode 36 and the focus cylinder 30.

The first and second centering cylinders of the center post 58 of the mandrel 52 maintain the concentricity for the mesh support electrode 36 and the focus cylinder 30 during the firing of the parts. The cylindrical stop 64 defined by the mutually adjacent surfaces of the first and second centering cylinder 60 and 62 maintains parallelism between the focus cylinder 30 and the mesh support electrode 36 while preventing the deformation of the glass ring 38 beyond the optimum level by acting as a stop against which the focus electrode 30 butts when the firing is completed.

Subsequent to the assembly procedure described above, the mutual alignment, i.e., the mutual parallelism and concentricity, between the mesh support electrode 36 and the focus cylinder 30 is maintained by the deformed, insulating glass ring 38 which is molded in situ so as to conform to the space between the electrode 36 and the cylinder 30. The focus electrode embossments 46 and the mesh support electrode embossments 44 engage and are embedded into the deformed glass ring 38 thereby securing the focus cylinder 30 and the mesh support electrode 36 in permanent, mutual alignment.

We claim:

1. In a pickup tube of the type including an evacuated hollow envelope, a hollow tubular focus electrode within said envelope, a cylindrical mesh support electrode spaced from said focus electrode, and aligning means for precisely aligning said mesh support electrode relative to said focus electrode, the improvement wherein said aligning means comprises:

first securing means extending radially outward from said focus electrode;

second securing means extending radially inward from said mesh support electrode; and insulating means thermally deformed in situ between said focus electrode and said mesh support electrode, said insulating means engaging said first securing means of said focus electrode and said second securing means of said mesh support electrode so that said focus electrode and said mesh support electrode are mutually parallel and concentric.

2. An electron tube according to claim 1, wherein said first securing means includes a plurality of embossments formed in the body of said focus electrode and spaced circumferentially about said electrode.

3. A pickup tube according to claim 1, wherein said second securing means includes a plurality of embossments spaced circumferentially about said mesh support electrode.

4. A pickup tube according to claim 3, wherein said plurality of embossments are formed in the body of said mesh support electrode as tabs struck from the electrode itself, said embossments extend from the body of said mesh support electrode.

5. A pickup tube according to claim 1, wherein said insulating means includes a glass ring.

6. A pickup tube according to claim 5, wherein said glass ring is preformed molded glass.

7. A pickup tube as in claim 1 wherein said first securing means and said second securing means are embedded into said insulating means.

8. A pickup tube as in claim 7 wherein said insulating means thermally deformed in situ conforms to the space between said focus electrode and said mesh support electrode and maintains the mutual alignment between said focus electrode and said mesh support electrode.

9. In a pickup tube of the type including an evacuated hollow envelope, a hollow tubular focus electrode within said envelope, a cylindrical mesh support electrode spaced from said focus electrode, and aligning means for precisely aligning said mesh support electrode relative to said focus electrode, the improvement wherein said aligning means comprises:

a plurality of embossments formed in the body of said focus electrode and spaced circumferentially about said electrode and extending radially outward therefrom, a plurality of circumferentially spaced tabs struck from the body of said mesh support electrode and extending radially inward therefrom;

a glass ring thermally deformed in situ between said focus electrode and said mesh support electrode, said ring electrically insulating said focus electrode from said mesh support electrode, said ring engaging said embossments of said focus electrode and said tabs of said mesh support electrode so that said focus electrode and said mesh support electrode are mutually parallel and concentric.

* * * * *